US008231254B2

(12) United States Patent
Beck et al.

(10) Patent No.: US 8,231,254 B2
(45) Date of Patent: Jul. 31, 2012

(54) LIGHTING UNIT FOR VEHICLE HEADLIGHTS AND VEHICLE HEADLIGHT

(75) Inventors: Jürgen Beck, Gerstetten/Heuchlingen (DE); Siegfried Foerstner, Herbrechtingen (DE); Peter Frey, Heidenheim (DE); Christian Meier, München (DE)

(73) Assignee: Osram AG, München (DE)

( * ) Notice: Subject to any disclaimer, the term of this patent is extended or adjusted under 35 U.S.C. 154(b) by 27 days.

(21) Appl. No.: 13/002,410

(22) PCT Filed: Jun. 16, 2009

(86) PCT No.: PCT/EP2009/057449

§ 371 (c)(1),
(2), (4) Date: Jan. 3, 2011

(87) PCT Pub. No.: WO2010/000610

PCT Pub. Date: Jan. 7, 2010

(65) Prior Publication Data

US 2011/0103076 A1 May 5, 2011

(30) Foreign Application Priority Data

Jul. 2, 2008 (DE) ..... 10 2008 031 256

(51) Int. Cl.
*F21V 19/02* (2006.01)
*F21V 21/14* (2006.01)

(52) U.S. Cl. ..... 362/523; 362/547; 362/549; 362/372; 362/373

(58) Field of Classification Search ..... 362/372, 362/545, 547, 549, 523, 546, 373, 294
See application file for complete search history.

(56) References Cited

U.S. PATENT DOCUMENTS

| | | | | |
|---|---|---|---|---|
| 4,851,968 | A * | 7/1989 | Nino | 362/539 |
| 7,753,575 | B2 * | 7/2010 | Mochizuki et al. | 362/545 |
| 7,806,562 | B2 * | 10/2010 | Behr et al. | 362/294 |

FOREIGN PATENT DOCUMENTS

| | | |
|---|---|---|
| DE | 10 2005 043 499 | 3/2007 |
| DE | 20 2007 008 956 | 9/2007 |
| DE | 10 2006 037 481 | 2/2008 |
| EP | 0 330 204 | 8/1989 |
| WO | WO 2006/066530 | 6/2006 |
| WO | WO 2007/146566 | 12/2007 |

* cited by examiner

*Primary Examiner* — Ali Alavi
(74) *Attorney, Agent, or Firm* — Cozen O'Connor

(57) ABSTRACT

A lighting unit for vehicle headlights comprising a light-emitting diode device (500), and a housing (200), in the interior of which are arranged components of an operating circuit for operating the light-emitting diode device (500), wherein the housing (200) is composed of electrically insulating material, electrical connections (222) for the voltage supply of the lighting unit are embedded in the housing (200), and the housing (200) has adjustment means (213*a*, 213*b*, 213*c*) for orienting the lighting unit in a vehicle headlight; wherein the light-emitting diode device (500) is arranged on a surface (112) of a heat sink (100) composed of thermally conductive material; and wherein the heat sink (100) forms a bearing surface (120*a*) for an external cooling system, said bearing surface being arranged at an outer side of the housing.

13 Claims, 7 Drawing Sheets

LIGHTING UNIT FOR VEHICLE HEADLIGHTS AND VEHICLE HEADLIGHT

RELATED APPLICATIONS

This is a U.S. national stage of application No. PCT/EP20091057449, filed on Jun. 16, 2009.

This application claims the priority of German application no. 10 2008 031 256.8 filed Jul. 2, 2008, the entire content of which is hereby incorporated by reference.

FIELD OF INVENTION

The invention relates to a lighting unit for vehicle headlights comprising a light emitting diode device.

BACKGROUND OF THE INVENTION

A lighting unit of this type is disclosed in WO 2008/065030 A1, for example. Said document describes a lighting unit for a vehicle headlight comprising a light-emitting diode device and a metallic housing, which at least partly encloses the light-emitting diode device and which is provided with fixing means for mounting the lighting unit in a vehicle headlight. Said fixing means are configured in such a way that they enable the light-emitting diode chips to be oriented relative to the optical unit of the vehicle headlight. The metallic housing can be connected to a cooling body for cooling the light-emitting diode chips. However, the production of the metallic housing is comparatively complicated and costly.

SUMMARY OF THE INVENTION

It is an object of the invention to provide a lighting unit of the generic type having a more cost-effective housing, wherein orientation of the lighting unit with respect to the optical unit of a vehicle headlight and accommodation of the electrical connections in the housing and also sufficient cooling of the light-emitting diode device are intended to be made possible.

One aspect of the invention is directed to a lighting unit that includes a light-emitting diode device, and a housing, in the interior of which are arranged components of an operating circuit for operating the light-emitting diode device. The housing is composed of electrically insulating material, preferably of plastic, and is provided with adjustment means for orienting the lighting unit in a vehicle headlight, and electrical connections for the voltage supply of the lighting unit are embedded in the housing, such that they are accessible to mating contacts or mount contacts of a vehicle headlight. In addition, the light-emitting diode device is fixed on a surface of a heat sink composed of thermally conductive material, said heat sink forming a bearing surface for an external cooling system, said bearing surface being arranged at an outer side of the housing.

The combination of the abovementioned features of the lighting unit ensures that the housing material can be utilized for electrically insulating the electrical connections and the housing can be formed cost-effectively for example as an injection-molded part, in particular as a plastic injection-molded part. In this case, the heat sink enables the light-emitting diode device to be thermally coupled to an external cooling system and thus provides for sufficient cooling or dissipation of the heat from the light-emitting diode device during the operation of the lighting unit.

The first adjustment means ensure orientation of the light-emitting diode device fixed on the metallic heat sink with respect to a possible optical unit of the lighting unit and with respect to an optical system of the vehicle headlight.

Advantageously, provision is made of second adjustment means for the relative orientation of light-emitting diode device, housing or heat sink. During the mounting of the lighting unit, said second adjustment means facilitate the orientation of its abovementioned components with respect to one another.

In accordance with an embodiment of the invention, the electrical connections of the lighting unit are accommodated in a housing section embodied as a plug or socket, in order to enable electrical contact being made between lighting unit and vehicle headlight by means of a simple plug connection. In this case, the electrically insulating material of the housing can advantageously be used for electrically insulating the electrical connections. By way of example, the entire housing of the lighting unit or only the housing section embodied as a plug or socket can be embodied as a plastic injection-molded part, into the plastic material of which the electrical connections are embedded. Good fixing and electrical insulation of the electrical connections are achieved as a result.

The first adjustment means advantageously comprise at least three elevations which are arranged along an outer circumference of the housing of the lighting unit according to the invention, in order thereby to be able to serve as a seating surface in the vehicle headlight.

The second adjustment means advantageously comprise a section of the metallic heat sink and boundaries of a precisely fitting cutout in the housing, in order, in the simplest possible manner, to prevent rotational movements between the heat sink and the housing and to ensure a defined orientation of the light-emitting diode device with respect to the housing.

The heat sink preferably has a disk-shaped section that forms the bearing surface or thermal coupling surface for an external cooling system. It is thereby possible to provide a large contact surface with a correspondingly good thermal coupling to the external cooling system.

The heat sink is preferably composed of metal, since metals have a very good thermal conductivity. In addition, a metallic heat sink, on account of its electrical conductivity, can also be utilized for the electromagnetic shielding of the lighting unit and the vehicle headlight. For this purpose, the metallic heat sink is advantageously electrically conductively connected to an electrical contact—which is at ground reference potential—of a mounting circuit board on which electrical components of the operating circuit are mounted. Via the abovementioned electrical contact and the metallic heat sink and also the external cooling system of the vehicle headlight, the metallic reflection surfaces of the vehicle headlight and possible metallic housing parts of the vehicle headlight can likewise be connected to the ground reference potential in order overall to ensure the electromagnetic compatibility of the vehicle headlight.

Advantageously, the abovementioned disk-shaped section of the heat sink and the boundaries of a precisely fitting cutout in the housing are embodied as protection against rotation, in order to prevent rotational movements of the heat sink about an axis perpendicular to its disk-shaped section in the housing. By way of example, the disk-shaped section of the heat sink preferably has for this purpose a geometry that deviates from rotational symmetry.

The second adjustment means advantageously comprise pins which are attached to the housing and which bear against the metallic heat sink in order to ensure a play-free fit of the metallic heat sink in the housing. The abovementioned webs can compensate for dimensioning tolerances during the production of the housing.

Advantageously, the second adjustment means comprise at least three webs which are integrally formed on the housing and together define a reference plane for the orientation of the light-emitting diode device or the surface of the metallic heat sink on which the light-emitting diode device is fixed.

A temperature sensor is preferably attached to the heat sink in order to monitor the operating temperature of the light-emitting diode device. Since the light-emitting diode device is fixed on the metallic heat sink, the latter is at the same temperature as the light-emitting diode device and, in contrast to the light-emitting diode device, affords enough space for accommodating a temperature sensor.

The lighting unit according to the invention can advantageously be used in a vehicle headlight, for example as a fog light or daytime running light or else as a low-beam light or high-beam light. The primary optical unit of the lighting unit can be correspondingly adapted to the abovementioned applications. It is furthermore also possible to use the lighting unit according to the invention for a direction indicator or as a rear light in the vehicle. For this purpose, by way of example, a light-transmissive orange-colored or red covering can be used as primary optical unit.

DETAILED DESCRIPTION OF THE DRAWINGS

Figure 1:
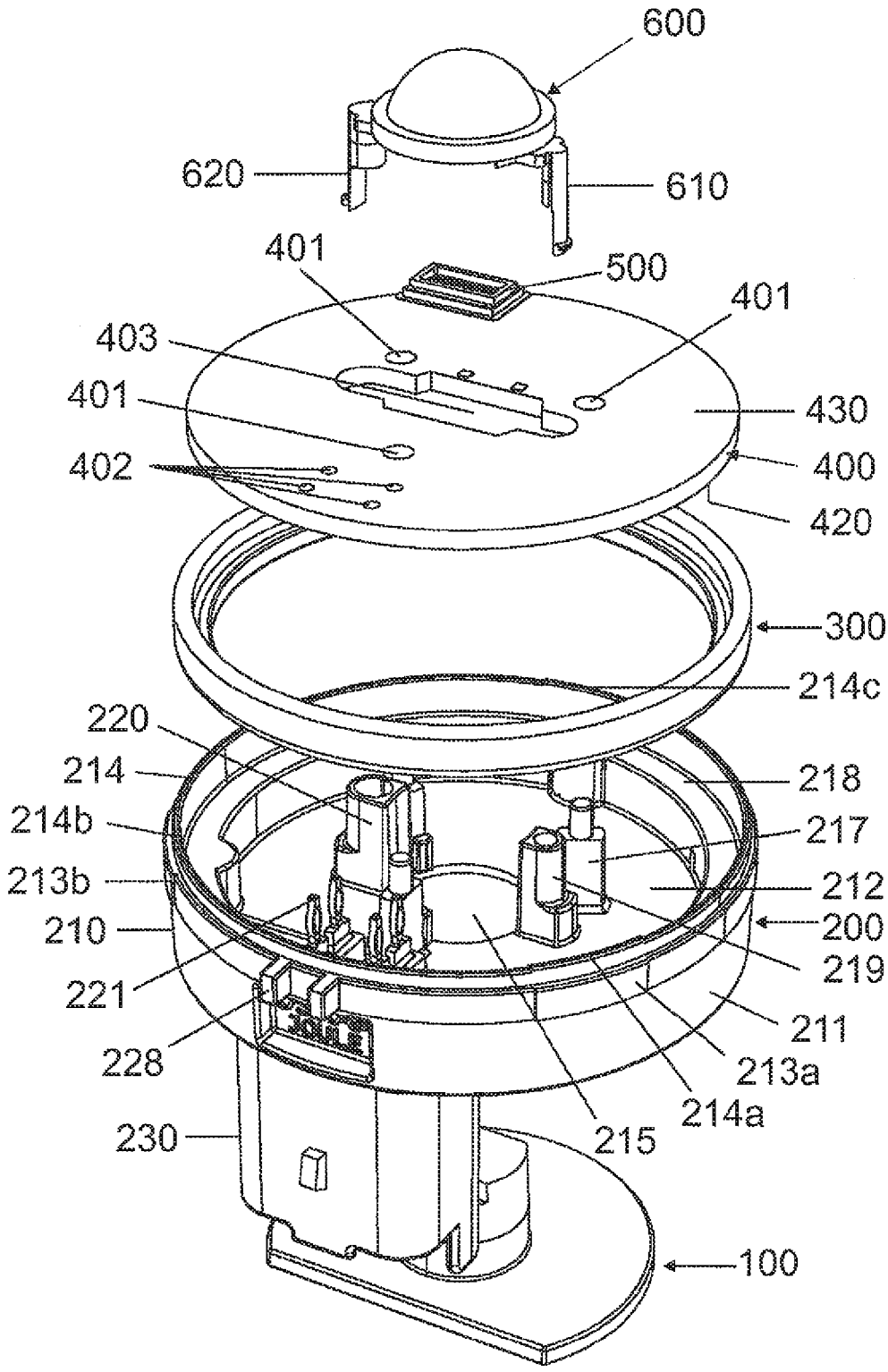
FIG. 1 shows an illustration of all the components of the lighting unit in accordance with the first exemplary embodiment of the invention in an exploded representation of the lighting unit

The lighting unit in accordance with the first exemplary embodiment of the invention has a housing 200 embodied as a plastic injection-molded part, a metallic heat sink 100 composed of aluminum, a sealing ring 300 composed of rubber or silicone, a mounting circuit board 400 with—arranged thereon—electrical components (not illustrated) and conductor tracks (not illustrated) and also contact surfaces (not illustrated), a light-emitting diode device 500 and a primary optical unit 600. FIG. 1 shows an exploded representation of the lighting unit with its individual components. The abovementioned components of this lighting unit and their interaction are described in greater detail below.

Figure 2:
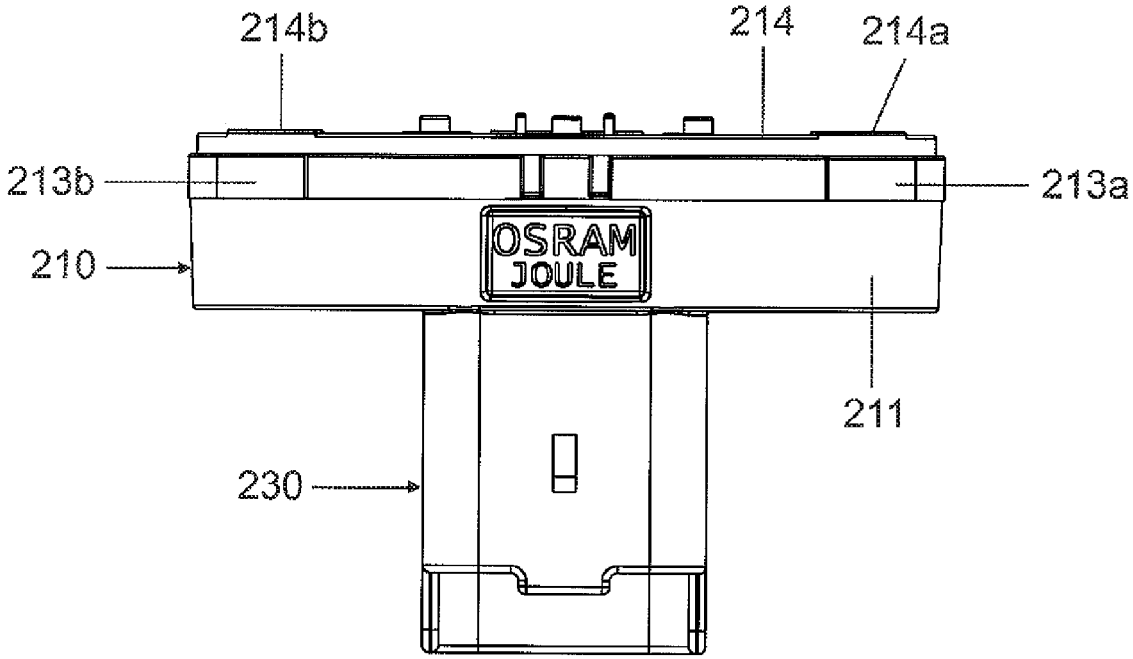
FIG. 2 shows a side view of the housing of the lighting unit illustrated in FIG. 1
Figure 3:
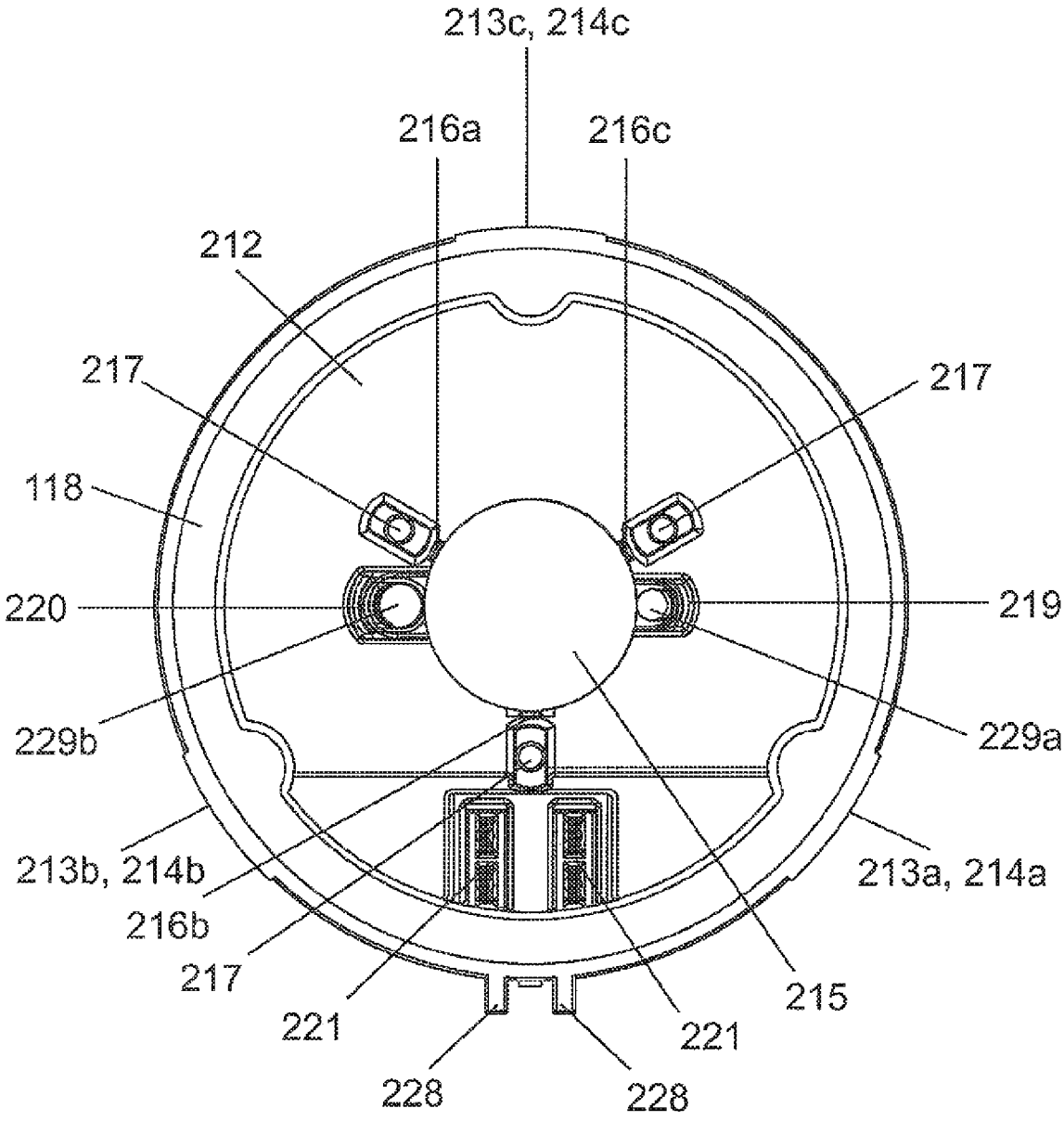
FIG. 3 shows a front view of the housing illustrated in FIG. 2
Figure 4:
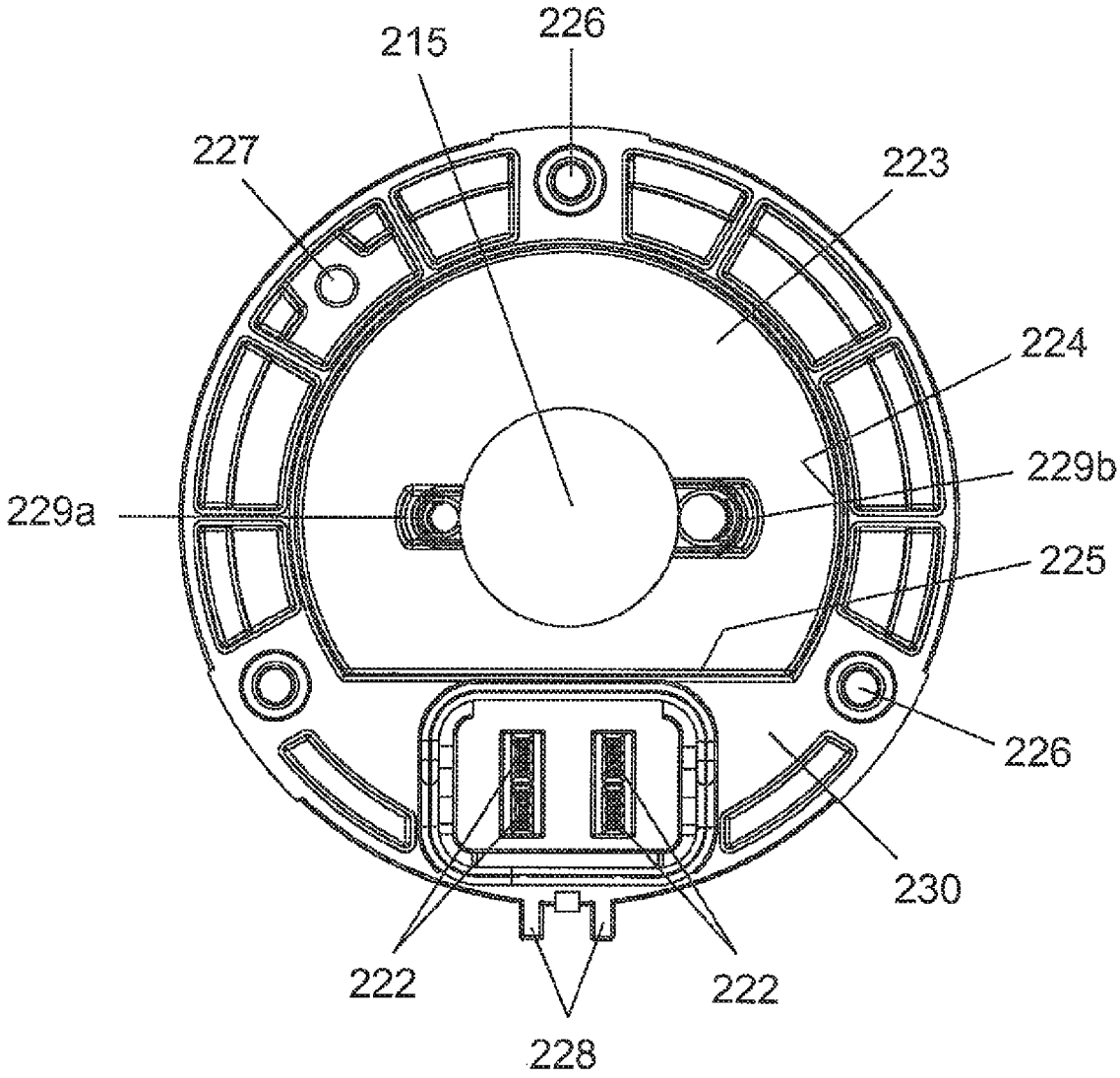
FIG. 4 shows a rear view of the housing illustrated in FIGS. 2 and 3

FIGS. 2 to 4 illustrate details of the housing 200. The housing 200 is embodied in one piece and as a plastic injection-molded part. It has a hollow-cylindrical housing section 210 and a housing section 230 embodied as a plug. The hollow-cylindrical housing section 210 has a circular-cylindrical sidewall 211 and a base 212. The hollow-cylindrical housing section 210 has an external diameter of 50 millimeters. The circular-cylindrical sidewall 211 is provided with three elevations 213*a*, 213*b*, 213*c* arranged equidistantly along its outer lateral surface and at the same height above the base 212, which elevations project outward from the lateral surface and serve as adjustment means for orienting the lighting unit in the vehicle headlight. In particular, these three elevations 213*a*, 213*b*, 213*c* define a reference external diameter of the hollow-cylindrical housing section 210 for the orientation of the lighting unit in the vehicle headlight. In the region of the elevations 213*a*, 213*b*, 213*c*, therefore, the external diameter of the housing section 210 is set to a value with high accuracy. Furthermore, the elevations 213*a*, 213*b*, 213*c* increase the wall thickness of the circular-cylindrical sidewall 211 in this region and stiffen the sidewall 211. The upper edge 214 of the hollow-cylindrical housing section 210 is provided with three webs 214*a*, 214*b*, 214*c* arranged equidistantly along the circumference of the hollow-cylindrical housing section 210. These three webs 214*a*, 214*b*, 214*c* form coaxially arranged ring segments which are integrally formed onto the upper edge 214 of the circular-cylindrical sidewall 211 and extend in the direction of the cylinder axis of the circular-cylindrical sidewall 211. The width of said webs 214*a*, 214*b*, 214*c*, that is to say their extent in the circumferential direction of the circular-cylindrical sidewall 211, corresponds to the width or extent of the elevations 213*a*, 213*b*, 213*c* along the outer lateral surface of the circular-cylindrical sidewall 211. The webs 214*a*, 214*b*, 214*c* are arranged along the circumference of the circular-cylindrical sidewall 211 at the same locations as the elevations 213*a*, 213*b*, 213*c*. The upper edges of the three webs 214*a*, 214*b*, 214*c* define a plane which runs perpendicularly to the cylinder axis of the hollow-cylindrical housing section 210 and serves as a reference plane for the orientation of the light-emitting diode device 500. The housing section 230 embodied as a plug is integrally formed eccentrically onto the base 212 of the hollow-cylindrical housing section 210 at the rear side. The base 212 has a circular-disk-shaped perforation 215 arranged coaxially with respect to the cylinder axis of the hollow-cylindrical housing section 210, through which perforation a column-like section 110 of the metallic heat sink 100 projects. The base 212 is equipped with three pins 216*a*, 216*b*, 216*c* on the inner side of the hollow-cylindrical housing section 210, said pins being arranged equidistantly along the edge of the circular-disk-shaped perforation 215 and extending parallel to the direction of the cylinder axis of the hollow-cylindrical housing section 210. Said pins 216*a*, 216*b*, 216*c* bear against a circular-cylindrical partial section 111 of the column-like section 110 of the metallic heat sink 100 and serve for orienting the metallic heat sink 100 in the plastic housing 200. In particular, the pins 216*a*, 216*b*, 216*c* ensure a play-free fit of the metallic heat sink 100 in the housing 200 and prevent movements of the metallic heat sink 100 in all directions perpendicularly to the cylinder axis of the hollow-cylindrical housing section 210. On the inner side, the base 212 is provided with three further pins 217, which likewise extend parallel to the cylinder axis of the hollow-cylindrical housing section 210 and serve for fixing the mounting circuit board 400. In particular, the tapered ends of said pins 217 project through perforations 401 in the mounting circuit board 400 and are hot caulked at the top side, that is to say at that side of the mounting circuit board 400 which faces away from the base 212. The circular-cylindrical side wall 211 has a ring-shaped collar 218 at its inner side, the sealing ring 300 bearing on said collar. The base 212 is additionally equipped with two hollow webs 219, 220, which extend parallel to the cylinder axis of the hollow-cylindrical housing section 210 and are arranged diametrically at the edge of the circular-disk-shaped perforation 215. Said webs 219, 220 serve for fixing the primary optical unit 600. Projections 229*a*, 229*b* are attached in the cavity of the webs 219, 220, the holder 610, 620 of the primary optical unit 600 latching in behind said projections. A plurality of metal pins 221 project from the base 212, said metal pins being electrically conductively connected to electrical connections of the lighting unit which are embedded in the plug 230, and said metal pins projecting through perforations 402 in the mounting circuit board 400 and being soldered or welded to conductor tracks or contact surfaces on the mounting circuit board 400 or being contact-connected thereto by means of press-fit or press-in zone. The electrical connections are furthermore connected to metallic contact pins 222 which project from the plastic material of the plug 230 and are accessible at the rear side of the lighting unit or of the housing section 230 embodied as a plug. On the outer side or rear side of the hollow-cylindrical housing section 210, the base 212 has a precisely fitting cutout 223 for a disk-shaped section 120 of the metallic heat sink 100. Said cutout 223 is delimited by a wall section 224 in the shape of a circle arc and a wall section 225 running in a rectilinear fashion. This non-rotationally symmetrical geometry of the cutout 223 and of the disk-shaped section 120 of the metallic heat sink 100 is used to realize protection against rotation, which prevents rotations of the metallic heat sink 100 about the axis of its cylindrical partial section 111 in the perforation 215 in the base 212 of the hollow-cylindrical housing section 210. In the base 212, three nuts 226 arranged in a ring-shaped fashion and equidistantly are situated on the rear side or outer side of the hollow-cylindrical housing section 210, said nuts being embedded and anchored in the plastic material of the housing section 210 in such a way that their screw thread is accessible for screwing on an external cooling system. Furthermore, a pressure compensating hole 227 is provided on the rear side of the hollow-cylindrical housing section 210, which hole, particularly in the case of closed systems, enables pressure compensation in the vehicle headlight. Said pressure compensating hole 227 is optional and can be covered by means of a pressure compensating membrane (not illustrated). Two reference lugs 228, which serve as a reference for the orientation of the lighting unit in the vehicle headlight, project from the outer side of the circular-cylindrical sidewall 211. In particular, said reference lugs 228 define an unambiguous installation position of the lighting unit in the vehicle headlight.

Figure 5:
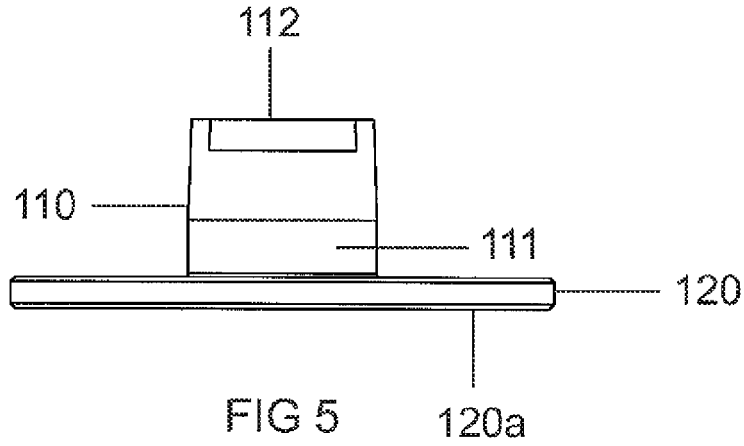
FIG. 5 shows a side view of the metallic heat sink of the lighting unit illustrated in FIG. 1
Figure 6:
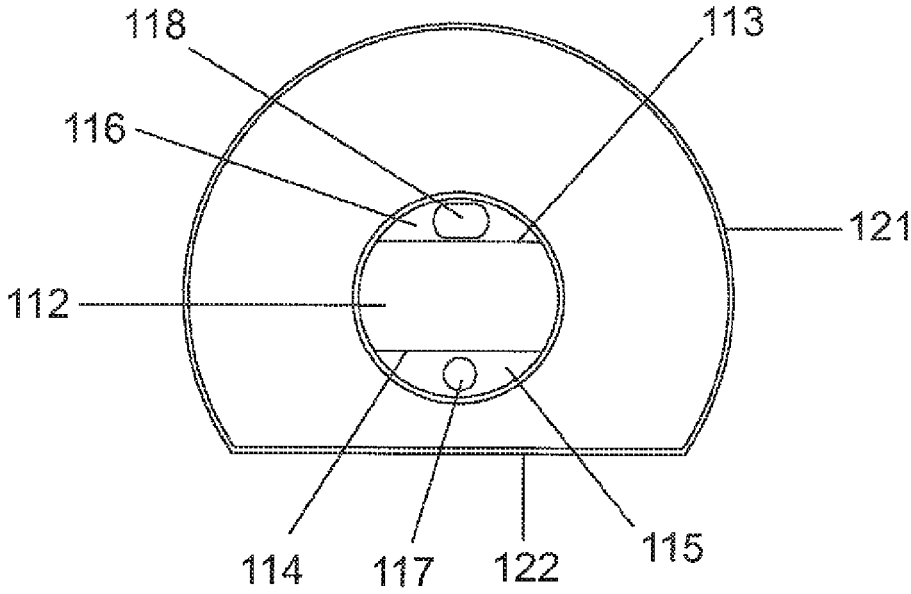
FIG. 6 shows a front view of the metallic heat sink illustrated in FIG. 5
Figure 7:
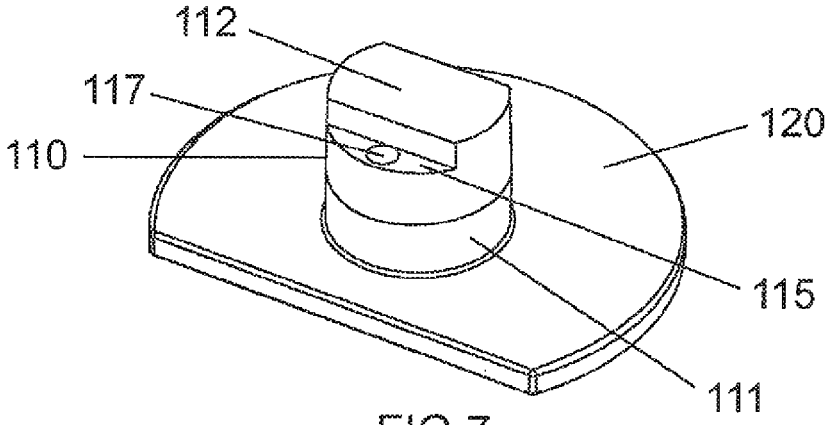
FIG. 7 shows a perspective illustration of the metallic heat sink illustrated in FIGS. 5 and 6
Figure 8:
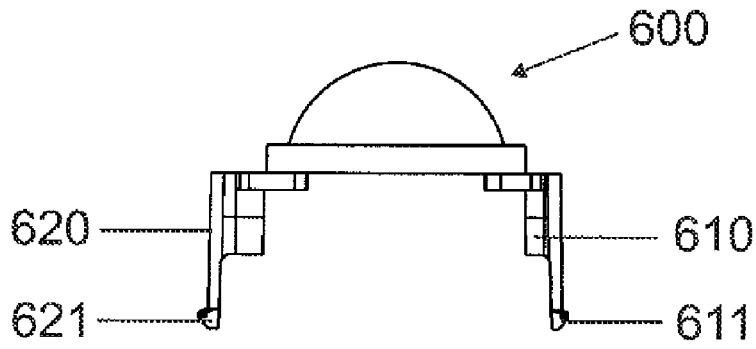
FIG. 8 shows a side view of the primary optical unit of the lighting unit illustrated in FIG. 1

Details of the metallic heat sink 100 are illustrated in FIGS. 5 to 7. It is embodied in one piece and is composed of aluminum. The metallic heat sink 100 is composed of a column-like section 110 and a disk-shaped section 120, which is integrally formed at one end of the column-like section 110. The rear side 120*a*—facing away from the column-like section 110—of the disk-like section 120 of the metallic heat sink 100 serves as a bearing surface for an external cooling system. The column-like section 110 has a circular-cylindrical partial section 111, which directly adjoins the disk-shaped section 120. The edge of the disk-shaped section 120 is formed by an edge section 121 in the shape of a circle arc and an edge section 122 running in a rectilinear fashion. The rectilinearly running edge section 122 of the heat sink 100 bears against the rectilinearly running wall section 225 in the cutout 223 and the edge section 121 of the heat sink 100 in the shape of the circle arc bears against the wall section of the cutout 223 in the shape of a circle arc. The column-like section 110 of the heat sink 100 projects through the perforation 215 in the base 212 of the hollow-cylindrical housing section 210 and the circular-cylindrical partial section 111 bears against the pins 216*a*, 216*b*, 216*c* in a play-free manner. The column-like section 110 has at its end a planar mounting surface 112 running parallel to the disk-shaped section 120, said mounting surface being delimited by two side edges 113, 114 running parallel to one another. The light-emitting diode device 500 is adhesively bonded on said mounting surface 112 with well-defined orientation and distance with respect to the side edges 113, 114 by means of an automatic placement machine. Situated on both sides of the mounting surface 112 is a respective surface 115, 116 running parallel to the mounting surface 112, said surface 115, 116 being arranged at a smaller height above the disk-shaped section 120 and in each case being provided with a depression 117, 118. The column-like section 110 of the heat sink 100 projects through a perforation 403 in the mounting circuit board 400, such that the mounting surface 112 lies in the plane defined by the upper edges of the webs 214*a*, 214*b*, 214*c* and the metallic heat sink 100 is fixed to the housing 200 in this vertical position by means of adhesive. In the depression 118 embodied as a slot, a temperature sensor is arranged and fixed by means of thermally conductive paste. The temperature sensor monitors the temperature of the light-emitting diode device 500 during the operation of the lighting unit. A metal spring is arranged in the other depression 117, said metal spring pressing with spring action against an electrical contact that is at ground reference potential on the mounting circuit board 400. As a result, the metallic heat sink 100 is connected to the ground reference potential and becomes part of an electromagnetic shield of the driver circuits for the light-emitting diode device. The electromagnetic compatibility of the lighting unit is thus improved.

The sealing ring 300 is composed of rubber or silicone and bears on the collar 218 on the inner side of the circular-cylindrical sidewall 211. The mounting circuit board 400, which carries the electrical components of the driver circuit for operating the light-emitting diode device, bears on the sealing ring 300.

The mounting circuit board 400 is embodied in a circular-disk-shaped fashion and has a central perforation 403 through which projects the column-like section 110 of the metallic heat sink 100 with the light-emitting diode device 500 fixed thereon. The mounting circuit board 400, the sealing ring 300, the circular-cylindrical sidewall 211 and the base 212 of the hollow-cylindrical housing section 210 form an interior. On the rear side 420 of the mounting circuit board 400 facing the interior, electrical components (not illustrated) of an operating circuit for operating the light-emitting diode arrangement 500 are arranged and, if appropriate, connected to one another by conductor tracks likewise arranged on the mounting circuit board. Arranged on the front side 430 of the mounting circuit board 400 are conductor tracks (not illustrated) and electrical contact surfaces (not illustrated) for making contact with the light-emitting diode device 500 and also, if appropriate, further components of the operating circuit which cannot cause high-frequency interference signals during their operation. The mounting circuit board 400 is preferably embodied in a multilayered fashion and has, in addition to the conductor tracks on the front side and rear side, an inner metal layer (not illustrated), which is embedded in the electrically insulating material of the mounting circuit board 400 and is connected to the ground reference potential of the operating circuit for the light-emitting diode device 500 in order to increase the electromagnetic compatibility of the lighting unit. The above-mentioned inner metal layer at ground reference potential contributes together with the metallic heat sink 100, which is likewise at ground reference potential, to the electromagnetic shielding of the electrical components of the operating circuit for the light-emitting diode device 500 which are arranged on the rear side of the mounting circuit board 400. The mounting circuit board 400 is provided with three holes 401 arranged all around the central perforation 403. After its mounting, the mounting circuit board 400 is seated on the pins 217, such that the tapered ends thereof project through the perforations 401. The mounting circuit board 400 is fixed to the housing 200 by hot caulking of the tapered ends of the pins 217. The mounting circuit board 400 additionally has four further holes 402, which are arranged at the edge thereof, above the housing section 230 embodied as a plug, and through which the metal pins 221 project in order to enable an electrically conductive connection to contact surfaces on the front side of the mounting circuit board 400. The central perforation 403 in the mounting circuit board 400 is configured such that holders 610, 620 of the primary optical unit 600 can also project through the perforation 403 and engage into the hollow webs 219, 220.

The light-emitting diode device 500 consists of five light-emitting diode chips which are arranged in a row on a carrier plate and are surrounded by the walls of a frame. Said light-emitting diode chips are provided with a phosphor coating (chip layer coating), which partly converts the blue light generated by the light-emitting diode chips into light having other wavelengths, such that the lighting unit emits light that appears white during its operation. The light-emitting diode chips are thin-film light-emitting diode chips, for example, the basic principle of which is described for example in the document I. Schnitzer et al., Appl. Phys. Lett. 63 (16), 18 October 1993, 2174-2176. By means of an automatic placement machine, the light-emitting diode device 500 is oriented parallel to the side edges 113, 114 and adhesively bonded centrally on the end face 112 of the column-like section 110 of the metallic heat sink 100 at an equal distance from the edges of the end face 112, which serves as a mounting surface. The light-emitting diode device 500 is electrically conductively connected to electrical contacts on the mounting circuit board 400 and is operated with the aid of the operating circuit, the components of which are arranged on the mounting circuit board 400. The operating circuit supplies the light-emitting diode chips of the light-emitting diode device 500 with current and, with the aid of the temperature sensor already mentioned above, makes it possible to regulate the electrical power consumption of the light-emitting diode device 500 in a manner dependent on the temperature of the light-emitting device 500. In the case of imminent overheating of the light-emitting diode device 500, for example, the current provided by the operating circuit for the light-emitting diode device 500 can be reduced. For this purpose, the temperature sensor can be embodied for example as a thermistor, in particular as an NTC thermistor having a negative temperature characteristic.

The primary optical unit 600 is a transparent, dome-like covering of the light-emitting diode device 500 composed of plastic or glass. The primary optical unit 600 has two hook-shaped holders 610, 620, which are inserted into the hollow webs 219, 220 and the hooks 611, 621 of which latch in place there behind the projections 229*a*, 229*b*. The web 220 is provided with a slot having an oval cross section, while the web 219 has a cavity having a circular edge. As a result, an unambiguous orientation can also be predefined for the primary optical unit 600. That is of importance if the transparent dome-like covering 600 is replaced by a primary optical unit having light-directing properties. However, the dome-like covering 600 can also be omitted or replaced by a primary optical unit having imaging properties or optical waveguide properties which directs or concentrates the light from the light-emitting diode device in predefined spatial directions.

Figure 9:
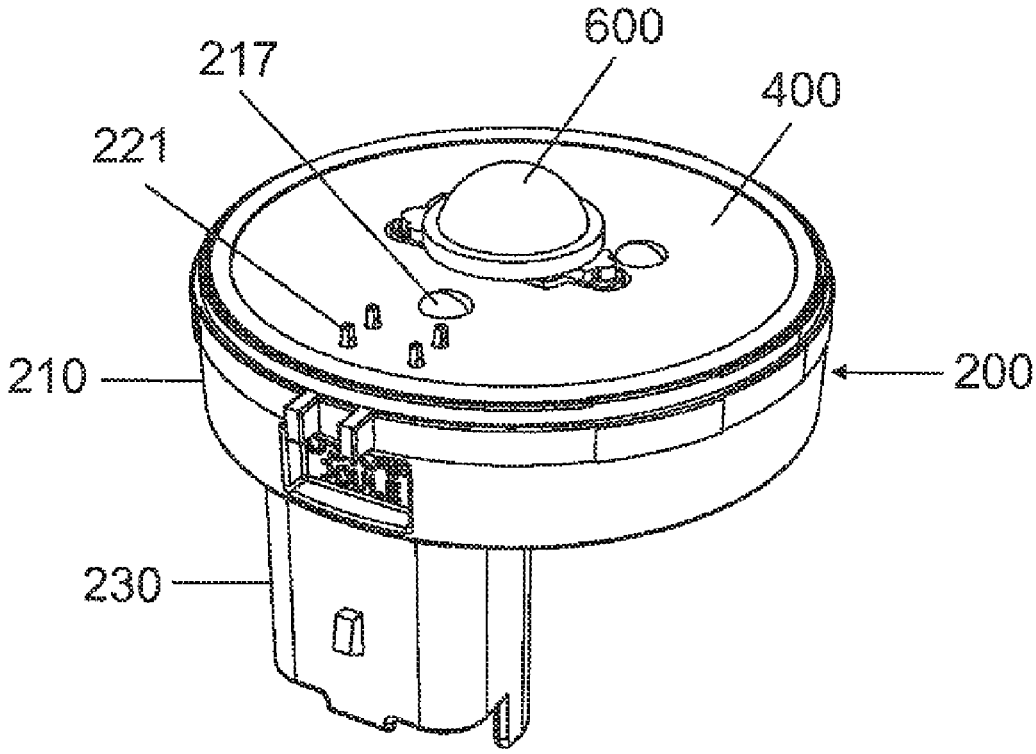
FIG. 9 shows a perspective illustration of the lighting unit illustrated in FIG. 1 in the mounted state of all its components

FIG. 9 illustrates the lighting device in accordance with the first exemplary embodiment of the invention in the mounted state of all its individual parts.

Figure 10:
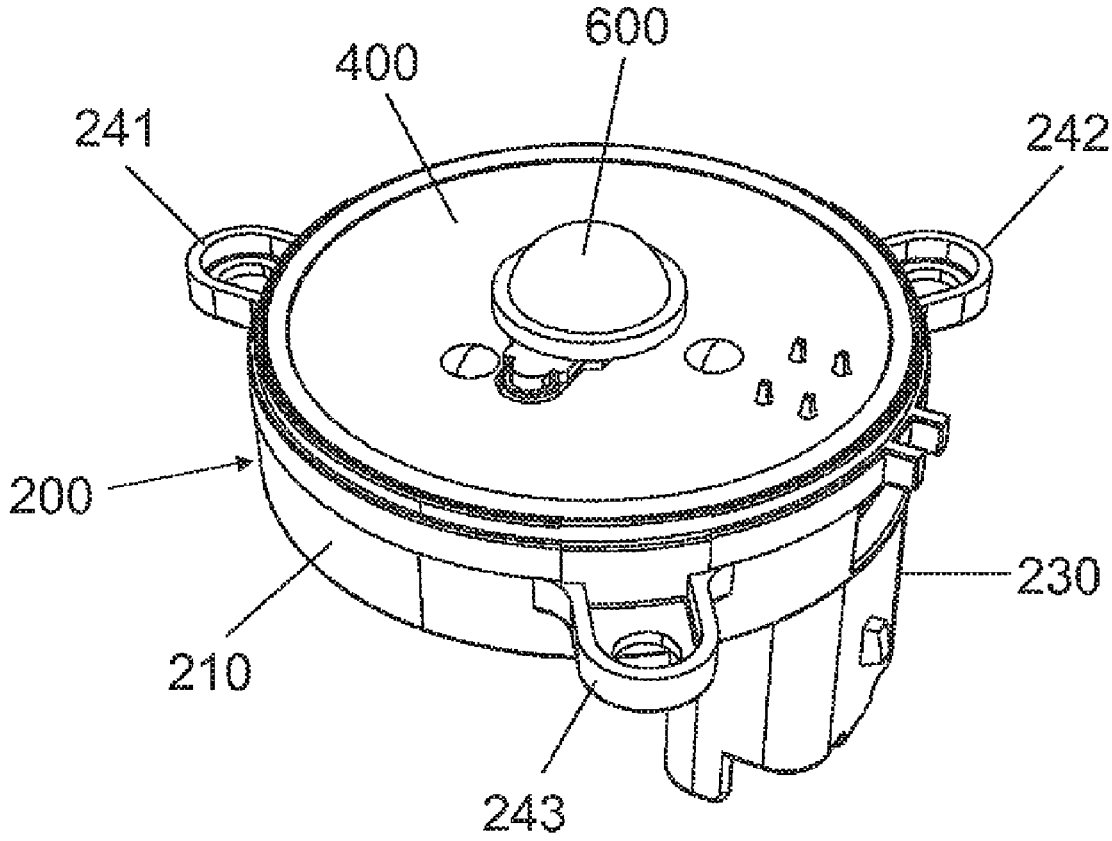
FIG. 10 shows a perspective illustration of a lighting unit in accordance with the second exemplary embodiment of the invention

FIG. 10 shows a lighting unit in accordance with a second exemplary embodiment of the invention. This lighting unit differs from the lighting unit in accordance with the first exemplary embodiment only in that the lighting unit in accordance with the second exemplary embodiment has three fixing devices 241, 242, 243, which are integrally formed on the housing 200 of the lighting unit in accordance with the second exemplary embodiment of the invention. The lighting units in accordance with the first and second exemplary embodiments of the invention correspond in all other details. For this reason, in FIG. 10 identical component parts bear the same reference symbols as the corresponding component parts of the first exemplary embodiment illustrated in FIGS. 1 to 9. The three holding devices 241, 242, 243 are lugs which are provided with holes and which are arranged equidistantly along the outer circumference of the hollow-cylindrical housing section 210 of the plastic housing 200. The lugs 241, 242, 243 provided with holes lie in a common plane perpendicular to the cylinder axis of the hollow-cylindrical housing section 210 and make it possible to fix the lighting unit with the aid of screws in the vehicle headlight.

The invention is not restricted to the exemplary embodiments explained in greater detail above. By way of example, the transparent, dome-like covering 600 can be dispensed with or replaced by a primary optical unit having optical imaging properties. Moreover, the heat sink can also be composed of other metals, such as copper, for example, or non-metals having good thermal conductivity.

The invention claimed is:

1. A lighting unit for vehicle headlights comprising a light-emitting diode device, and a housing, in the interior of which are arranged components of an operating circuit for operating the light-emitting diode device, wherein the housing is composed of electrically insulating material, electrical connections for the voltage supply of the lighting unit are embedded in the housing, and the housing has adjustment means for orienting the lighting unit in a vehicle headlight;

wherein the light-emitting diode device is arranged on a surface of a heat sink composed of thermally conductive material; and wherein the heat sink forms a bearing surface for an external cooling system, said bearing surface being arranged at an outer side of the housing.

2. The lighting unit as claimed in claim 1, wherein the adjustment means are formed by at least three elevations arranged along an outer circumference of the housing.

3. The lighting unit as claimed in claim 1, wherein provision is made of second adjustment means for the relative orientation of light-emitting diode arrangement housing or heat sink.

4. The lighting unit as claimed in claim 3, wherein the second adjustment means comprise a section of the heat sink and boundaries of a precisely fitting cutout in the housing.

5. The lighting unit as claimed in claim 4, wherein the disk-shaped section and the boundaries of the precisely fitting cutout in the housing are embodied as protection against rotation, which prevents a rotation of the heat sink about an axis perpendicular to its disk-shaped section in the cutout.

6. The lighting unit as claimed in claim 1, wherein the second adjustment means comprise pins which are attached to the housing and which bear against the metallic heat sink.

7. The lighting unit as claimed in claim 1, wherein the second adjustment means comprise at least three webs which are integrally formed on the housing and together form a reference plane for the orientation of the tight-emitting diode device or the surface of the heat sink on which the light-emitting diode device is fixed.

8. The lighting unit as claimed in claim 1, wherein the bearing surface is formed by a disk-shaped section of the heat sink.

9. The lighting unit as claimed in claim 1, wherein the housing has a section which is embodied as a plug or socket and in which the electrical connections are accommodated.

10. The lighting unit as claimed in claim 1, wherein a temperature sensor is arranged on the heat sink.

11. The lighting unit as claimed in claim 1, wherein the heat sink is composed of metal.

12. The lighting unit as claimed in claim 11, wherein the components of the operating circuit are arranged on a mounting circuit board and the mounting circuit board has an electrical contact which is at the ground reference potential of the operating circuit and is electrically conductively connected to the metallic heat sink.

13. A vehicle headlight comprising a lighting unit as claimed in claim 1.

* * * * *